US011840898B2

(12) United States Patent
Nguyen et al.

(10) Patent No.: US 11,840,898 B2
(45) Date of Patent: Dec. 12, 2023

(54) INTELLIGENT SECTION MILL, METHOD, AND SYSTEM

(71) Applicants: Tuan Nguyen, Pearland, TX (US); Charles Meador, Cypress, TX (US)

(72) Inventors: Tuan Nguyen, Pearland, TX (US); Charles Meador, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/557,974

(22) Filed: Dec. 21, 2021

(65) Prior Publication Data

US 2023/0193712 A1 Jun. 22, 2023

(51) Int. Cl.
*E21B 29/00* (2006.01)
*E21B 10/32* (2006.01)

(52) U.S. Cl.
CPC ..... *E21B 29/005* (2013.01); *E21B 10/322* (2013.01)

(58) Field of Classification Search
CPC .... E21B 29/005; E21B 10/322; E21B 10/265; E21B 10/26
See application file for complete search history.

(56) References Cited

U.S. PATENT DOCUMENTS 11,248,429 B2 * 2/2022 Delgado ..... E21B 29/005
2007/0205022 A1 * 9/2007 Treviranus ..... E21B 10/322 175/77
2009/0266544 A1 * 10/2009 Redlinger ..... E21B 29/005 166/298
2010/0089583 A1 * 4/2010 Xu ..... E21B 47/13 175/57
2013/0199785 A1 * 8/2013 Hekelaar ..... E21B 29/005 166/55.7
2014/0060933 A1 3/2014 Rasheed
(Continued)

FOREIGN PATENT DOCUMENTS

CN 107218007 A 9/2017
CN 112252987 A 1/2021
WO 2019038535 A1 2/2019

OTHER PUBLICATIONS

Notification of Transmittal of the International Search Report and the Written Opinion of the International Searching Authority, or the Declaration; PCT/US2022/052502; dated Apr. 19, 2023; 13 pages.

*Primary Examiner* — Shane Bomar
(74) *Attorney, Agent, or Firm* — CANTOR COLBURN LLP

(57) ABSTRACT

A section mill including a housing, a cutter pivotally connected to the housing, a drive piston operably connected to the cutter to radially expand or retract the cutter depending upon longitudinal position of the drive piston relative to the housing, and a limit configuration in operable contact with the drive piston to limit drive piston stroke responsive to hydraulic pressure on the drive piston. A method for cutting casing including determining condition of a structure radially outward of a casing to be cut, selecting an amount of expansion of a cutter based upon the determining, and cutting the casing. A borehole system including a borehole in a subsurface formation, a string in the borehole, and a section mill as in any prior embodiment disposed in the borehole.

18 Claims, 6 Drawing Sheets

(56) References Cited

U.S. PATENT DOCUMENTS

| | | | | |
|---|---|---|---|---|
| 2015/0176369 | A1* | 6/2015 | Nguyen | E21B 23/02 166/308.1 |
| 2015/0211314 | A1* | 7/2015 | McAfee | E21B 29/00 166/250.01 |
| 2015/0267493 | A1* | 9/2015 | Schwartze | E21B 29/005 166/55.7 |
| 2015/0376966 | A1* | 12/2015 | Balasubramanian | E21B 29/005 166/55.7 |
| 2016/0222764 | A1 | 8/2016 | Rorvik | |
| 2017/0198538 | A1* | 7/2017 | Hansen | E21B 29/002 |
| 2017/0321509 | A1* | 11/2017 | Hart | E21B 29/005 |
| 2018/0163498 | A1* | 6/2018 | Hendel | E21B 33/064 |
| 2019/0203538 | A1* | 7/2019 | Wisinger, Jr. | E21B 17/041 |
| 2021/0254422 | A1* | 8/2021 | Sheiretov | E21B 23/01 |

* cited by examiner

INTELLIGENT SECTION MILL, METHOD, AND SYSTEM

BACKGROUND

In the downhole resource recovery and fluid sequestration industries casing may require cutting for various reasons. Casing cutters are known in the art but require significant application of torque. Applied torque is available but is not always efficient. Since efficiency is paramount in the downhole industry, the art would welcome alternative configurations that support efficient operations.

SUMMARY

An embodiment of a section mill including a housing, a cutter pivotally connected to the housing, a drive piston operably connected to the cutter to radially expand or retract the cutter depending upon longitudinal position of the drive piston relative to the housing, and a limit configuration in operable contact with the drive piston to limit drive piston stroke responsive to hydraulic pressure on the drive piston.

An embodiment of a method for cutting casing including determining condition of a structure radially outward of a casing to be cut, selecting an amount of expansion of a cutter based upon the determining, and cutting the casing.

An embodiment of a borehole system including a borehole in a subsurface formation, a string in the borehole, and a section mill disposed in the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
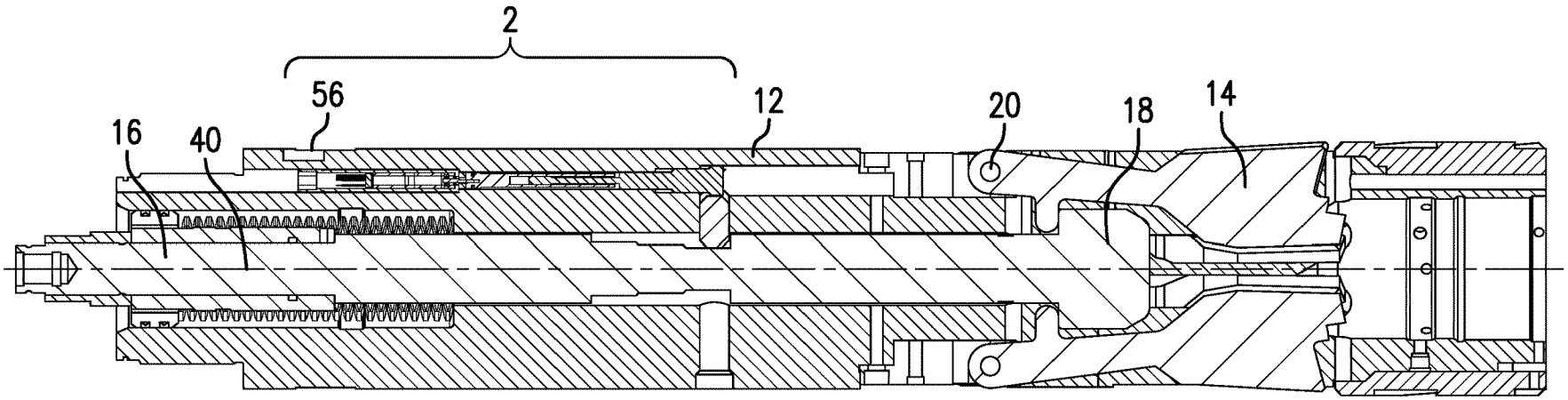
FIG. 1 is a sectional view of a section mill as disclosed herein.
Figure 2:
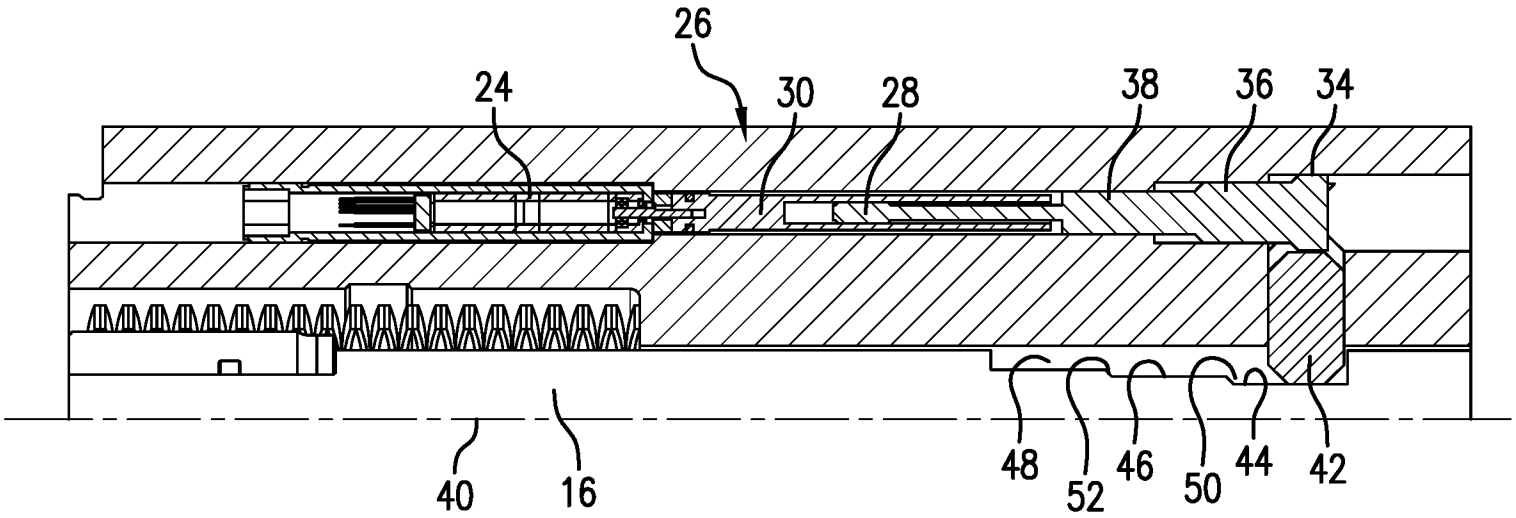
FIG. 2 is an expanded view of a bracketed area 2 of FIG. 1.
Figure 3:
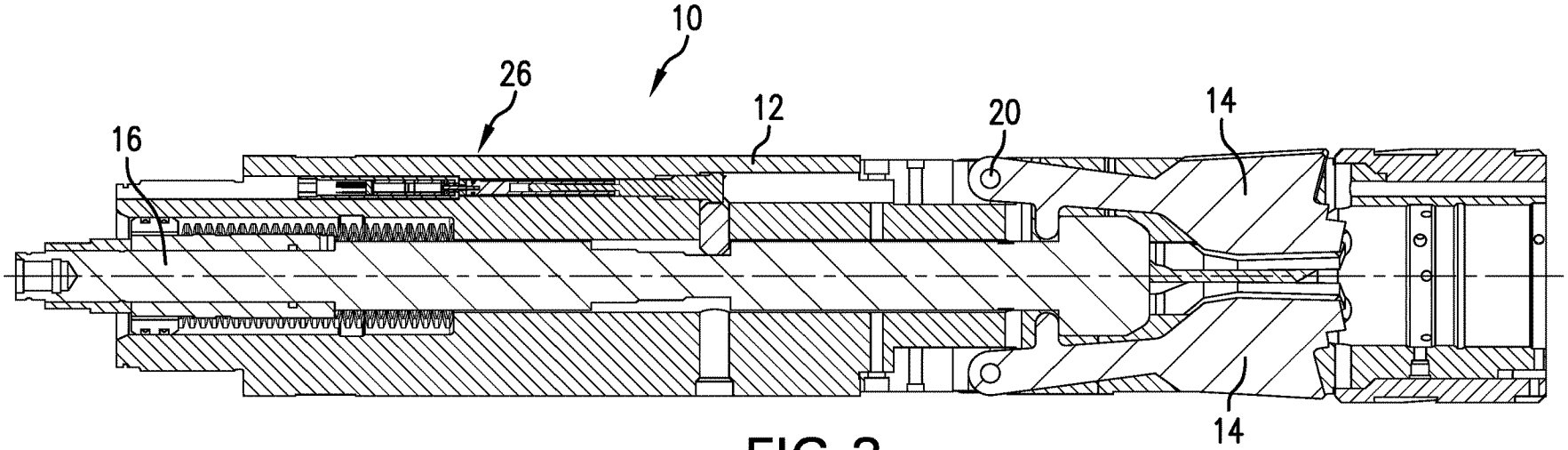
FIGS. 3-5 are sequential views of the mill illustrated in FIG. 1 in various positions.
Figure 4:
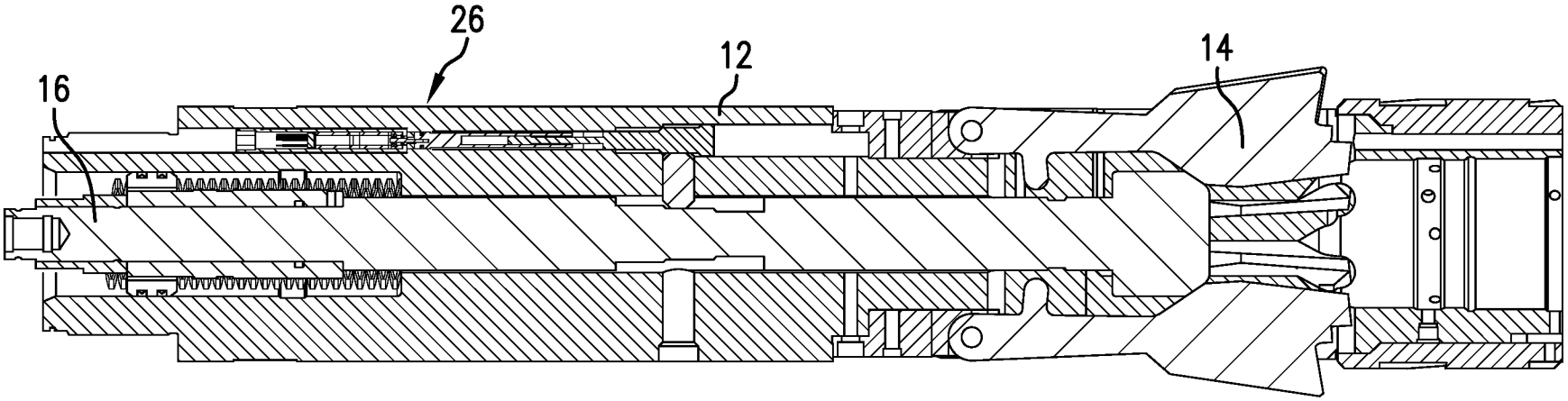
Figure 5:
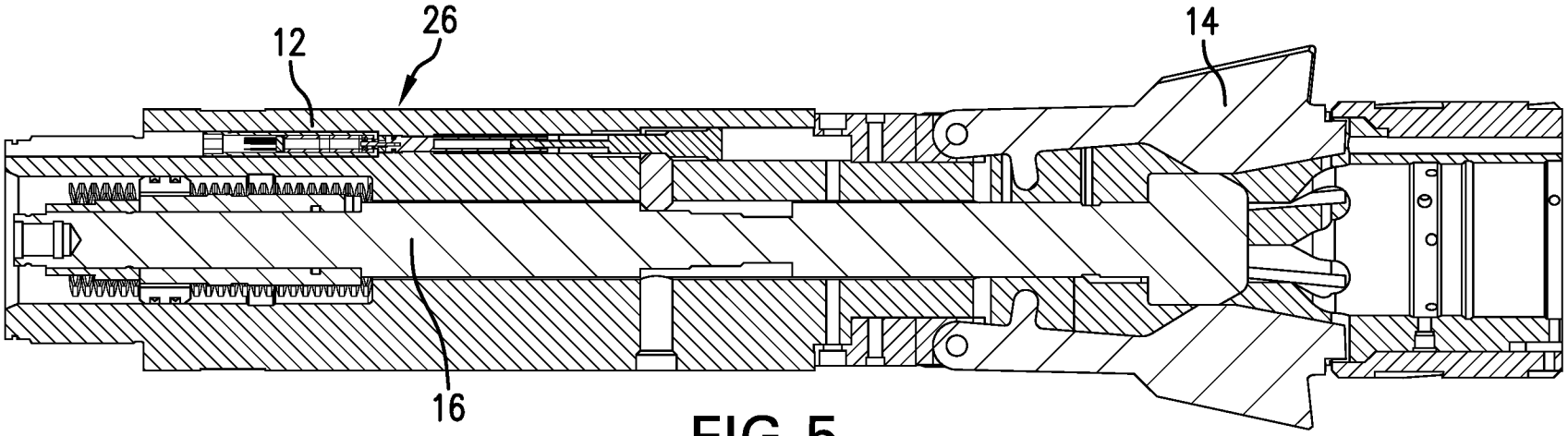

Referring to FIG. 1, a section mill 10 is illustrated. Mill 10 includes a housing 12 having a cutter 14 therein that is actuatable to pivot to a radially larger position by a drive piston 16. Drive piston 16 is responsive to tubing pressure from uphole of the mill 10. Upon the application of pressure on drive piston 16 (from the left of Figure), the piston 16 shifts downhole (to the right of the figure) relative to the housing 12 causing a piston head 18 to force a cutter(s) 14 radially outwardly by pivoting the cutter(s) 14 about pivot pin 20. Disposed in operative contact with the rest of mill 10 is electric limit configuration 22. In an embodiment, the configuration 22 is disposed at least partially within the housing 12. The limit configuration 22 includes, in an embodiment, an electric motor assembly 24 that is connected to a driver 26. Driver 26 in an embodiment is configured as a lead screw 28 and follower nut 30 (also describable as a box threaded shaft) such that axial length of the driver 26 may be changed by rotation of the motor assembly 24. Extension or contraction of the driver 26 causes a position change to a pushblock 32. The pushblock 32 includes steps 34, 36, and 38 that have a different dimension from a longitudinal axis 40 of the mill 10. While three steps are illustrated in the Figures, it is contemplated that more or fewer steps might be employed in various embodiments. Because of the different dimensions from the longitudinal axis of the mill 10, the position of the pushblock 32 will move a shuttle dog 42 either radially inwardly or radially outwardly depending upon what position the pushblock 32 was in immediately prior to the current consideration of its new position. Shuttle dog 42 interacts with the drive piston 16 at limit lands 44, 46 and 48 depending upon which step, 34, 36, or 38 the shuttle dog 42 is on. Specifically, the shuttle dog 42 will contact step 34 and limit land 44, contact step 36 and limit land 46 or contact step 38 and limit land 48 based upon position of the pushblock 32. These contact positions limit the movement of the drive piston 16 such that the radial pivoting of the cutter 14 is limited. For example, with the pushblock 32 in the illustrated position, which is of course mediated by the electric motor assembly 24 positioning the pushblock 32 through the driver 26. As illustrated in FIG. 2, the driver 26 has positioned the pushblock 32 to align step 34 with the shuttle dog 42. This in turn urges the shuttle dog 42 toward the axis 40 of mill 10 and causes shuttle dog 42 to contact land 44. With the shuttle dog 42 in contact with land 44, the drive piston 16 can move to the right of the figure, toward actuation of the cutter 14 only to a transition 50 between land 44 and land 46. Further motion of the drive piston 16 to the right of figure is not possible as the shuttle dog 42 will jam against the transition 50 between land 44 and land 46. If the pushblock 32 were positioned to contact the shuttle dog 42 at step 36, the drive piston 16 would be limited against further downhole movement at transition 52 between land 46 and 48. Similar activity would result regardless of number of steps and lands employed. In each case, the limitation on rightward movement of the piston 16 relative to housing 12 translates directly into the degree of radial pivot of the cutter(s) 14 such that control of how large the cutter(s) is may be controlled by the electric motor 24. This is illustrated in FIGS. 3, 4 and 5 where the mill 10 is illustrated in a run in position, a radially smaller cutting position and a radially larger cutting position, respectively.

Advantageously, the configuration of the mill 10 as disclosed allows for a selection of radial cutting depth which directly translates to cutting torque. Specifically, it will be appreciated that there is a cutting torque associated with the cutters 14 being fully radially deployed. The greater the radial length of an arm from an axial driving member, the greater the torque required to turn that drive member. If the actual cutting operation desired does not require the full radial position of the cutter to achieve its goal, then by fully deploying the cutters 14, one is merely increasing the torque that must be suppled to turn the mill 10 without need or benefit. In such a situation, for example, where the cement outside of a casing section where a cut is to be performed is not strong, the mill operation would be successful if the cutter only cut through the casing and did not reach into the cement at all. Were this to be the case, a reduced torque could be employed on the mill 10 and reduce wear on all components in the system. Such control has never been available in a mill in the art. With the capability the mill 10 provides, additional benefit can be reaped by pairing the mill 10 with a controller 54 (either disposed with the mill 10 or disposed remotely therefrom or at the surface) and information about the condition of the borehole outside of the casing whether that be cement or formation structure or simply annulus. Each of these would change decisions made about how far to extend the cutters 14. A bond log may be used for this information, the log having been created previously, or the mill 10 may be paired with a sensory apparatus 56 such as an acoustic logging device to acquire real time conditions radially outwardly of the casing to be cut. With this information, the operator or a downhole controller, may send signals to the motor 24 to cause the cutters 14 to deploy only as far as needed to achieve the desired result.

Figure 6:
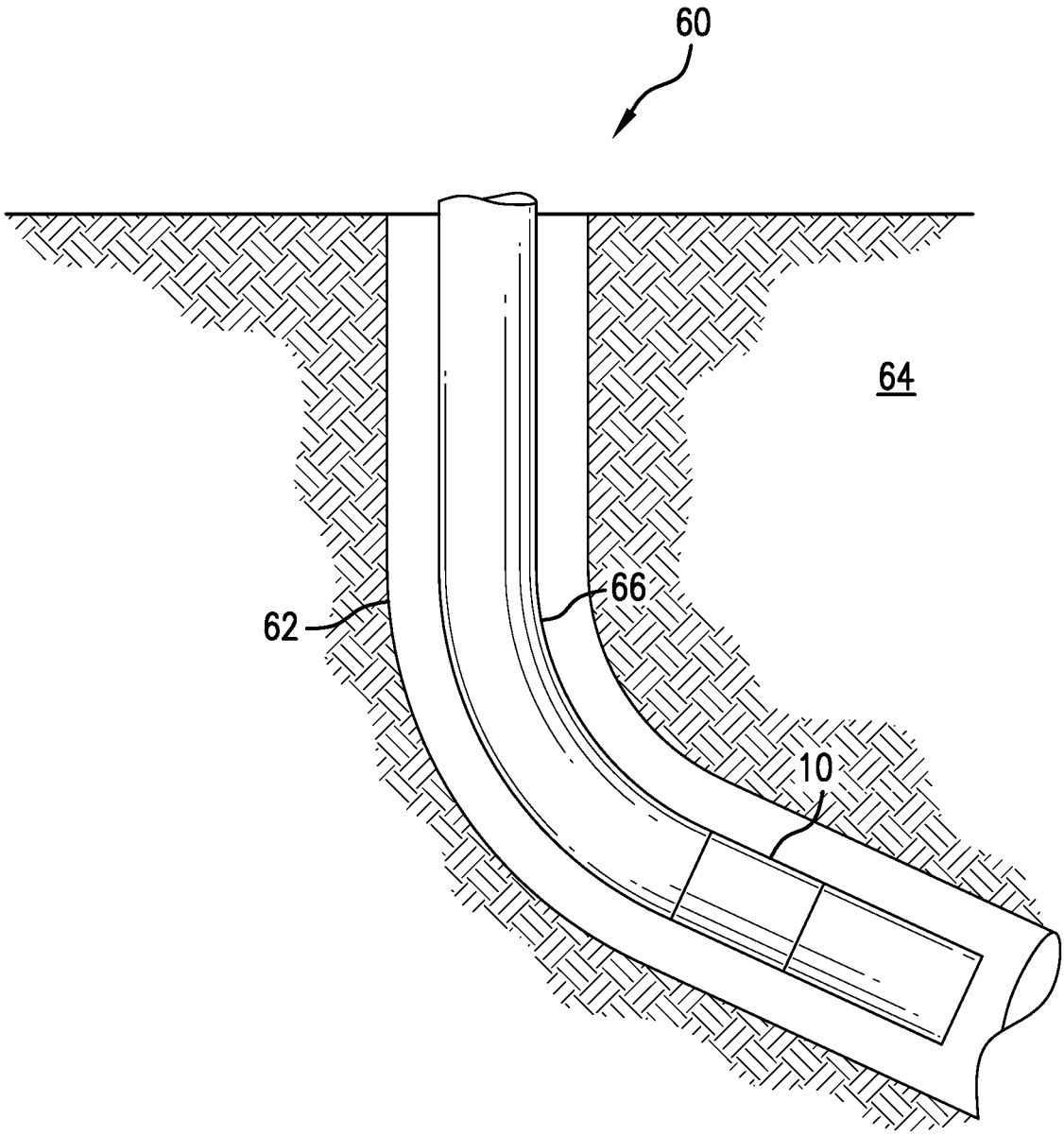
FIG. 6 is a view of a borehole system including the section mill disclosed herein.

Referring to FIG. 6, a borehole system 60 is illustrated. The system 60 comprises a borehole 62 in a subsurface formation 64. A string 66 is disposed in the borehole 62 and in an embodiment constitutes the casing to be cut. The mill 10 as disclosed above may be run on an additional string 68. Further included in the system is a sensory apparatus 56 configured to determine condition of material radially outward of the casing string 66. The mill 10 may also include the controller 54 therein or elsewhere in the system 60.

Set forth below are some embodiments of the foregoing disclosure:

Embodiment 1: A section mill including a housing, a cutter pivotally connected to the housing, a drive piston operably connected to the cutter to radially expand or retract the cutter depending upon longitudinal position of the drive piston relative to the housing, and a limit configuration in operable contact with the drive piston to limit drive piston stroke responsive to hydraulic pressure on the drive piston.

Embodiment 2: The mill as in any prior embodiment wherein the limit configuration comprises an electric motor and a driver.

Embodiment 3: The mill as in any prior embodiment wherein the driver is a lead screw and follower.

Embodiment 4: The mill as in any prior embodiment wherein the limit configuration includes a pushblock.

Embodiment 5: The mill as in any prior embodiment wherein the pushblock has a plurality of steps thereon.

Embodiment 6: The mill as in any prior embodiment wherein the pushblock contacts a shuttle dog that is in turn in contact with the drive piston and limits movement of the drive piston based upon shuttle dog position.

Embodiment 7: The mill as in any prior embodiment wherein the drive piston includes a plurality of lands selectively interactive with the shuttle dog.

Embodiment 8: The mill as in any prior embodiment wherein the mill includes a sensory apparatus to sense condition of structure radially outwardly of a casing to be cut.

Embodiment 9: The mill as in any prior embodiment wherein the sensory apparatus is an acoustic sensor.

Embodiment 10: The mill as in any prior embodiment wherein the mill employs log data to position the limit configuration.

Embodiment 11: A method for cutting casing including determining condition of a structure radially outward of a casing to be cut, selecting an amount of expansion of a cutter based upon the determining, and cutting the casing.

Embodiment 12: The method as in any prior embodiment wherein the determining is by reading a log.

Embodiment 13: The method as in any prior embodiment wherein the determining is by sensing structure radially outside of the casing to be cut.

Embodiment 14: The method as in any prior embodiment wherein the selecting includes limiting an actuation stroke to limit radial expansion of the cutter.

Embodiment 15: The method as in any prior embodiment wherein the limiting is running an electric motor to move a pushblock mechanically connected to a drive piston that physically limits movement of the drive piston.

Embodiment 16: The method as in any prior embodiment wherein the selecting includes communicating a signal to a limit configuration that limits the expansion of the cutter.

Embodiment 17: The method as in any prior embodiment wherein the communicating is from a controller local to the cutter.

Embodiment 18: A borehole system including a borehole in a subsurface formation, a string in the borehole, and a section mill as in any prior embodiment disposed in the borehole.

Embodiment 19: The borehole system as in any prior embodiment further including a controller in communication with the limit configuration.

Embodiment 20: The borehole system as in any prior embodiment wherein the controller is disposed in the same housing as the limit configuration.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A section mill comprising:

a housing;

a cutter pivotally connected to the housing;

a drive piston operably connected to the cutter to radially expand or retract the cutter depending upon longitudinal position of the drive piston relative to the housing; and a limit configuration including a pushblock in operable contact with the drive piston to limit drive piston stroke responsive to hydraulic pressure on the drive piston, wherein the pushblock contacts a shuttle dog that is in turn in contact with the drive piston and limits movement of the drive piston based upon shuttle dog position.

2. The mill as claimed in claim 1 wherein the limit configuration comprises an electric motor and a driver.

3. The mill as claimed in claim 2 wherein the driver is a lead screw and follower.

4. The mill as claimed in claim 1 wherein the pushblock has a plurality of steps thereon.

5. The mill as claimed in claim 1 wherein the drive piston includes a plurality of lands selectively interactive with the shuttle dog.

6. The mill as claimed in claim 1 wherein the mill includes a sensory apparatus to sense condition of structure radially outwardly of a casing to be cut.

7. The mill as claimed in claim 6 wherein the sensory apparatus is an acoustic sensor.

8. The mill as claimed in claim 1 wherein the mill employs log data to position the limit configuration.

9. A method for cutting casing comprising:

determining condition of a structure radially outward of a casing to be cut;

selecting an amount of expansion of a cutter based upon the determining, wherein the selecting includes limiting an actuation stroke to limit radial expansion of the cutter, and wherein the limiting is running an electric motor to move a pushblock mechanically connected to a drive piston that physically limits movement of the drive piston; and cutting the casing.

10. The method as claimed in claim 9 wherein the determining is by reading a log.

11. The method as claimed in claim 9 wherein the determining is by sensing structure radially outside of the casing to be cut.

12. The method as claimed in claim 9 wherein the selecting includes communicating a signal to a limit configuration that limits the expansion of the cutter.

13. The method as claimed in claim 12 wherein the communicating is from a controller local to the cutter.

14. A borehole system comprising:

a borehole in a subsurface formation;

a string in the borehole; and a section mill as claimed in claim 1 disposed in the borehole.

15. The borehole system as claimed in claim 14 further including a controller in communication with the limit configuration.

16. The borehole system as claimed in claim 15 wherein the controller is disposed in the same housing as the limit configuration.

17. A section mill comprising:

a housing;

a cutter pivotally connected to the housing;

a drive piston operably connected to the cutter to radially expand or retract the cutter depending upon longitudinal position of the drive piston relative to the housing; and a limit configuration in operable contact with the drive piston to limit drive piston stroke responsive to hydraulic pressure on the drive piston, wherein the mill employs log data to position the limit configuration.

18. A method for cutting casing comprising:

determining condition of a structure radially outward of a casing to be cut;

selecting an amount of expansion of a cutter based upon the determining, wherein the selecting includes communicating a signal to a limit configuration that limits the expansion of the cutter; and cutting the casing.

* * * * *